US005362326A

United States Patent [19]

Hasui et al.

[11] Patent Number: 5,362,326

[45] Date of Patent: Nov. 8, 1994

[54] APPARATUS FOR FORMING CORROSION PROTECTION COATINGS ON PRESTRESSING STRAND

[75] Inventors: Takeshi Hasui, Asahikawa; Takatsugu Fujikawa, Ebetsu, both of Japan

[73] Assignee: Kurosawa Construction Co., Ltd., Tokyo, Japan

[21] Appl. No.: 45,865

[22] Filed: Apr. 14, 1993

[30] Foreign Application Priority Data

Nov. 13, 1992 [JP] Japan ..... 4-304038

[51] Int. Cl.[5] ..... B05C 13/00

[52] U.S. Cl. ..... 118/44; 118/33; 118/308; 118/325; 118/DIG. 22; 57/1 UN; 57/221

[58] Field of Search ..... 118/33, 44, 630, 641, 118/65, 308, 325, DIG. 22; 156/48; 427/175, 375; 57/217, 221, 223, 1 UN; 140/147, 149

[56] References Cited

U.S. PATENT DOCUMENTS

| | | | |
|---|---|---|---|
| 3,334,357 | 9/1967 | Marzocchi et al. | 118/44 |
| 3,972,304 | 8/1976 | Boucher | 118/44 |
| 4,205,515 | 6/1990 | Garner | 118/44 |
| 5,208,077 | 5/1993 | Proctor et al. | 118/634 |
| 5,263,307 | 11/1993 | Hasui | 57/1 UN |

FOREIGN PATENT DOCUMENTS

| | | | |
|---|---|---|---|
| 4-111937 | 4/1992 | Japan | 140/149 |
| 4-123832 | 4/1992 | Japan | 140/149 |
| 4-313439 | 11/1992 | Japan | 140/149 |

*Primary Examiner*—W. Gary Jones
*Assistant Examiner*—Dean T. Nguyen
*Attorney, Agent, or Firm*—Nikaido, Marmelstein, Murray & Oram

[57] ABSTRACT

Disclosed is a method of forming corrosion protection coatings on prestressing strands. It comprises the steps of untwisting sequential lengths of a prestressing strand; keeping the surrounding steel wires apart from the core steel wire to coat these steel wires with a synthetic resin; and twisting the coated steel wires to provide a prestressing strand of the original shape, thus permitting the separate coating of each steel wire, leaving, on the prestressing strand surface, the helical dent as deep and wide as the noncoated prestressing strand to assure the bond of the twisted wire to the surrounding concrete as firm as the noncoated prestressing strand. Also, an apparatus for carrying out such coating method is disclosed.

4 Claims, 6 Drawing Sheets

APPARATUS FOR FORMING CORROSION PROTECTION COATINGS ON PRESTRESSING STRAND

BACKGROUND OF THE INVENTION

1. Field of the Invention

The present invention relates to a method and apparatus of forming corrosion protection coatings on prestressing strands to be used as tensioning members in a prestressed concrete structure, and particularly to a method and apparatus of forming individually protected strands by synthetic resin coatings.

2. Description of Related Art

To provide prestress in concrete by means of a pretensioning method or post-tensioning method, prestressing strands are used as tensioning members. At present, as such a prestressing strand, it is customary to use one having no corrosion protection coatings thereon.

Achievement of prestress in the concrete is mainly attributable to the bond between the surrounding concrete and the prestressing strand surfaces, specifically the helical dents of the strand surfaces formed by twisting of the side wires. Therefore, the forming of corrosion protection coatings on prestressing strand will reduce appreciably the width and depth of every helical dent of the strand, accordingly reducing the bond of the strand surfaces to the surrounding concrete.

To prevent reduction of the bond of the prestressing strand surfaces to the surrounding concrete, Japanese Patent 59-130960(A) (corresponding to U.S. patent application Ser. No. 437,274) proposed "anti-corrosion strand for use in prestressed concrete structure". It teaches a strand which has thick synthetic resin coatings on the strand surfaces and sand particles being blown against the coatings to be partly buried and exposed.

Conventional prestressing strands, however, have anti-corrosion coatings only on their outer surfaces, and no coatings are applied to the spaces between the core steel wire and the surrounding steel wires. If there should be pinholes in the anti-corrosion coating of the prestressing strand, damp air or water would invade inside of the coating through its pinholes, thereby corrosion could occur within in the core and surrounding wires.

As for the conventional prestressing strand having a sand-buried coating thereon, disadvantageously extra work is required for attaching sand particles on the strand, and if such rough-surfaced strands are gripped and pulled with hands, there is a fear of hurting the hands.

SUMMARY OF THE INVENTION

One object of the present invention is to provide a method of forming corrosion protection synthetic resin coatings on prestressing strands, which assures that prestressing strands are prevented from corrosion, and that corrosion protection coated strands may be handled without fear of hurting hands.

Another object of the present invention is to provide an apparatus for forming corrosion protection synthetic resin coatings on prestressing strands to assure that the strands are prevented from corrosion, and that corrosion protection strands may be handled without fear of hurting hands.

To attain these objects a method of forming corrosion protection coatings on prestressing strands according to the present invention comprises the steps of: untwisting sequentially selected lengths of a prestressing strand having a core steel wire and plural surrounding steel wires wound about the core wire; applying pulverized synthetic resin on each of the surrounding and core steel wires thus untwisted to form coatings on all steel wires; heating and melting such synthetic resin applied to all steel wires; and rewinding the untwisted sequential length of the resin-coated surrounding steel wires about the core steel wire.

Also, an apparatus for forming corrosion protection coatings on prestressing strands according to the present invention comprises: means for loosening and untwisting sequentially selected lengths of a prestressing strand having a core steel wire and plural surrounding steel wires wound about the core wire; means for applying pulverized synthetic resin on each of the surroundings and core steel wires thus untwisted to form coatings on all steel wires; means for heating and melting such synthetic resin applied to all steel wires; means for cooling the resin-coated surrounding and core steel wires; and means for tightening and winding the untwisted sequential length of the resin-coated surrounding steel wires about the core steel wire.

According to the present invention, sequentially selected lengths of a prestressing strand are untwisted one after another; pulverized synthetic resin is applied on each of the surrounding and core steel wires thus untwisted; such synthetic resin applied to all steel wires is heated and melted; and the resin-coated surrounding steel wires are again wound about the core steel wire, whereby all of the core and surrounding steel wires are evenly coated with synthetic resin, providing coatings without reducing the width and depth of each dent of the twisting of the surrounding steel wires about the core steel wire, thus enabling the corrosion protection twisted wires to stick to the surrounding concrete as firm as noncoated twisted wires. Arrangement of resin applying means and heating means between untwisting means and twisting means-permits a series of such coating steps to be performed sequentially and continuously.

Other objects and advantages of the present invention will be understood from the following preferred embodiments of the present invention which are shown in accompanying drawings.

DESCRIPTION OF THE PREFERRED EMBODIMENTS

Figure 1:
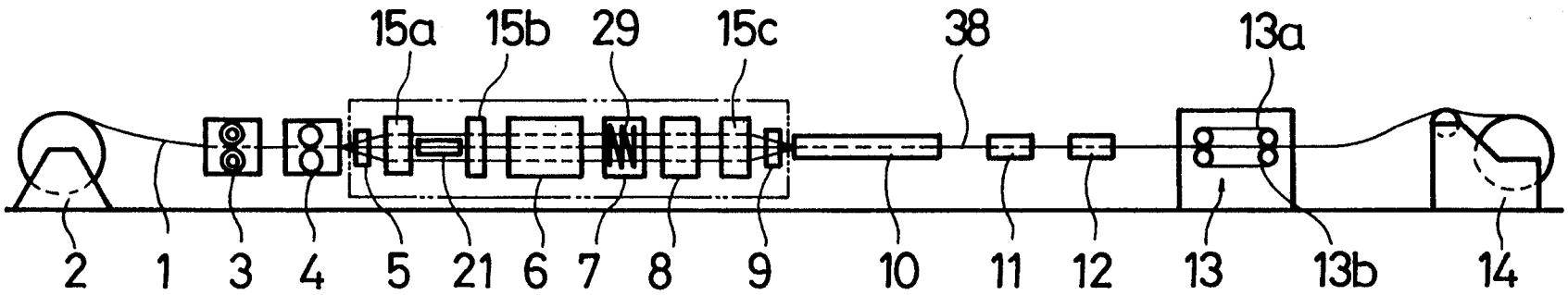
FIG. 1 shows schematically an apparatus for forming corrosion protection coatings on prestressing strands.
Figure 2:
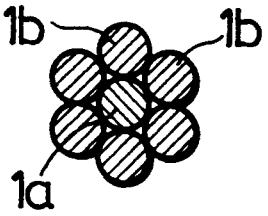
FIG. 2 is a cross section of a prestressing strand.

FIG. 1 shows an apparatus for forming coatings on prestressing strands according to the present invention. A prestressing strand 1 comprises a core steel wire 1*a* and a plurality of surrounding steel wires 1*b* helically wound thereabout as shown in FIG. 2. A uncoiling stand 2 bearing a coiled lot of such prestressing strand 1 feeds the prestressing strand 1 which is to be coated with a synthetic resin, and a coiling stand 14 at the downstream end to wind the coated strand in the form of coil. Specifically, between the uncoiling stand 2 at the upstream end and the coiling stand 14 at the downstream end there are a pull-out roll 8, a polishing means 4, a loosening-and-untwisting means 5, a coating means 6, a heating means 7, a primary cooling means 8, a tightening-and-retwisting means 9, a secondary cooling means 10, a diameter measuring means 11, a pinhole detecting means 12 and a pull-in means 13 in the order named. Wire expanding means 15*a*, 15*b* and 15*c* for keeping the surrounding steel wires 1*b* apart from the core steel wire 1*a* of a prestressing strand 1 and a core-length adjusting means 21 are arranged between the loosening-and-untwisting means 5 and the tightening-and-retwisting means 9.

The prestressing strand 1 is hauled out from the uncoiling stand 2 by the pull-out roll 8 at a predetermined speed, and the prestressing strand 1 is stretched between the uncoiling stand 2 and the coiling stand 14. The pull-out roll 8 comprises upper and lower rolls to grip and pull the prestressing strand 1 at a predetermined speed, which corresponds to the speed at which the prestressing strand 1 is fed while being coated with a synthetic resin in the strand coating apparatus.

The prestressing strand 1 is rubbed with wire brushes to remove rust, dust or fat from the prestressing strand 1 in the polishing unit 4. Then, the prestressing strand 1 thus rust removed and cleaned is fed to the loosening-and-untwisting unit 5 so that sequential lengths of prestressing strand 1 are untwisted, and the surrounding steel wires 1*b* are kept apart from the core steel wire 1*a* in the first, second and third wire expanding units 15*a*, 15*b* and 15*c*.

Figure 3:
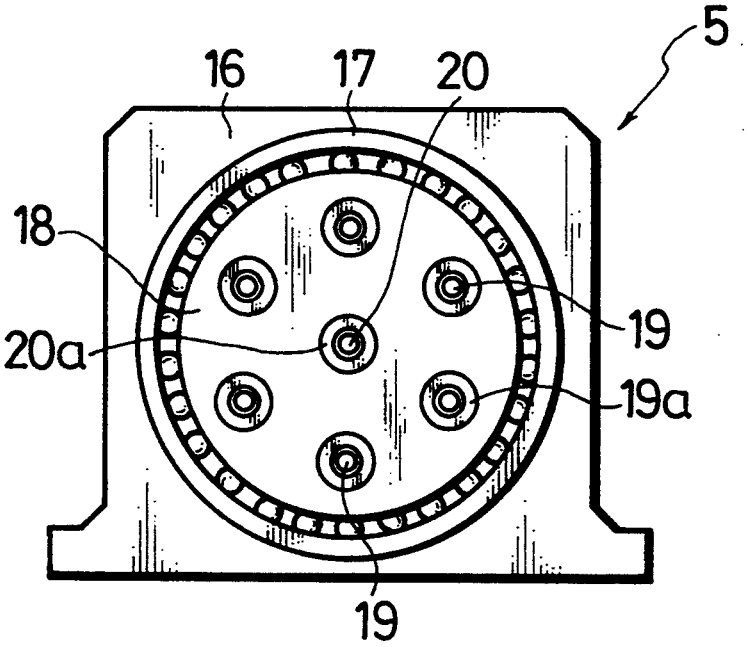
FIG. 3 is a front view of loosening-and-untwisting means.
Figure 4:
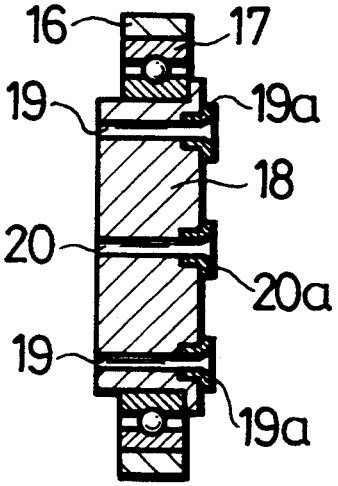
FIG. 4 is a side sectional view of the loosening-and-untwisting means.

As shown in FIGS. 3 and 4, the loosening-and-untwisting unit 5 comprises a rotary disk 18 rotatably fitted in an annular radial bearing 17, which is fixed to a stationary stand 16. The rotary disk 18 has a core wire guide aperture 20 at its center and a plurality of surrounding wire guide apertures 19 on its circumference. Each guide aperture has a bush 19*a* or 20*a* of a hard metal such as alumina to prevent wearing and enlarging of the guide hole.

A sequential selected length of prestressing strand 1 is untwisted by unwinding the end of tile prestressing strand and by passing tile core wire 1*a* and the surrounding wires 1*b* through the center and circumferential guide apertures respectively. As seen from FIG. 1, the first and second wire expanders 15*a* and 15*b* are placed upstream of the coating unit 6, and tile third wire expander 15*c* is placed between the first cooling unit 8 and the tightening-and-twisting unit 9.

These wire expanders 15*a*, 15*b* and 15*c* have substantially the same structure as the loosening-and-untwisting unit 5, although the wire expanders 15*a*, 15*b* and 15*c* are larger than the loosening-and-untwisting unit 5. Accordingly, the circumferential guide apertures of each wire expander are radially more apart from tile center guide aperture than the circumferential guide apertures of the loosening-and-untwisting unit 5.

The core-length adjusting unit 21 is placed between the first wire expander 15*a* and the second expander 15*b*. The core-length adjusting unit 21 comprises a stationary sheave 22 and a movable sheave 23, and the movable sheave 23 is spring-biased for instance by a coiled spring 24 so as to be kept apart from the stationary sheave 22. These sheaves 22 and 23 are supported by parallel support rods 25.

The untwisted prestressing strand 1 is fed from the first wire expander 15*a* and the second expander 15*b* to the tightening-and-twisting unit 9 through the coating unit 6, the heating unit 7, the primary cooling unit 8 and the third expander 15*c*, and is subjected to the sequential treatments with the surrounding steel wires kept apart from the core steel wire in these units so that the untwisted and coated wires are twisted in the tightening-and-retwisting unit 9 to provide a corrosion protection coated prestressing strand.

The coating unit 6 uses, for instance, an electrostatic coating method according to which the core and surrounding wires are coated with pulverized synthetic resin.

Figure 6:
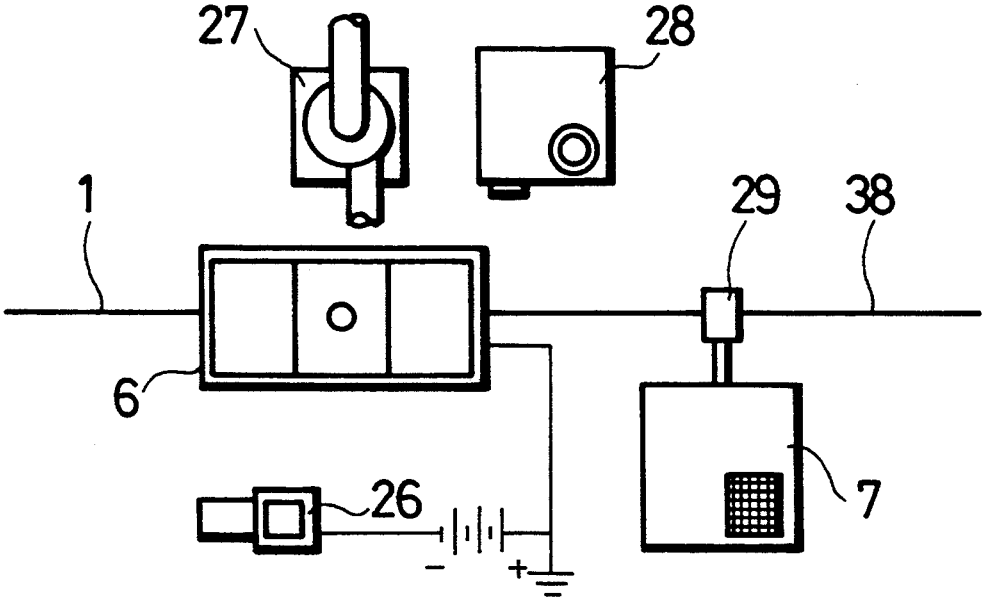
FIG. 6 shows the manner in which electrostatic application of pulverized synthetic resin on a prestressing strand is effected.
Figure 7:
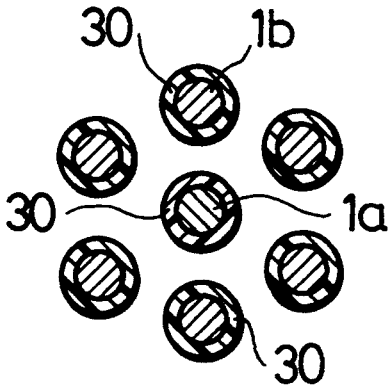
FIG. 7 is a cross section of the coated core and surrounding steel wires prior to the twisting of the untwisted and coated wires.

As shown in FIG. 6, the coating unit 6 comprises a pulverized synthetic resin feeder 26, a pulverized synthetic resin collector 27 and a dust collector 28. Pulverized synthetic resin carries a electrical charge, and is suspended in the surrounding atmosphere in the coating unit. The untwisted and separated core and surrounding steel wires are grounded and soaked in the suspension of pulverized synthetic resin to attract pulverized synthetic resin onto the core and surrounding steel wire surfaces. The coating thickness can be controlled by controlling the feeding speed of the untwisted steel wires and the feeding amount of pulverized synthetic resin.

After finishing application of pulverized synthetic resin to the core and surrounding steel wire surfaces, the untwisted steel wires are shifted to the heating unit 7, which preferably uses a high-frequency induction heating means for the sake of facilitating the controlling of temperature. The high-frequency induction heating coil 29 is used to heat the pulverized synthetic resin applied to the core and surrounding steel wires for instance, at 250° C., thereby melting the pulverized synthetic resin to form corrosion protection coatings 30 on the core and surrounding steel wires 1*a* and 1*b*.

The untwisted steel wires thus coated with synthetic resin are fed to the primary cooling unit 8, in which the wire temperature is reduced to a temperature low enough to cause no problem in the subsequent process. These coating unit 6, heating unit 7 and primary cooling unit 8 are separated by partitions 32.

The tightening-and-retwisting unit 9 is positioned downstream to the primary cooling unit 8 to wind the surrounding steel wires 1*b* about the core steel wire 1*a*. The tightening-and-retwisting unit 9 has same structure as the loosening-and-untwisting unit 5, and is used symmetrically with the loosening-and-untwisting unit 5.

Figure 8:
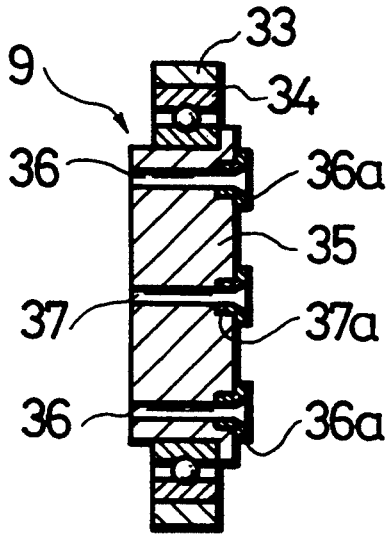
FIG. 8 is a side sectional view of a tightening-and-retwisting means.

As shown in FIG. 8, the tightening-and-retwisting unit 9 comprises a rotary disk 35 rotatably fitted in an annular radial bearing 34, which is fixed to a stationary stand 33. The rotary disk 35 has a core wire guide aperture 37 at its center and a plurality of surrounding wire guide apertures 36 on its circumference. Each guide aperture has a bush 36*a* or 37*a* of a hard metal such as alumina to prevent wearing and enlarging of the guide hole.

The untwisted wires are twisted by passing the core steel wire 1*a* and the surrounding steel wires 1*b* through the center and circumferential guide apertures 37 and 36 respectively, thereby setting the surrounding steel wires 1*b* about the core steel wire 1*a* so as to wind thereabout. Then, these steel wires are pulled at the wire-feeding rate, and the rotary disk 35 rotates to follow rotation of the wire expander 15*c*, thereby winding the surrounding steel wires 1*b* about the core steel wire 1*a* to provide a prestressing strand.

The wire expander 15*c* is rotated synchronously with the preceding wire expanders 15*a* and 15*b*. The rotation is caused by unwinding the surrounding steel wires 1*b* in tile loosening-and-untwisting unit 5, specifically by forced rotation of the rotary disk 18, which forced rotation is transmitted to all wire expanders 15*a*, 15*b* and 15*c* by the surrounding steel wires 1*b*. Thus, the rotary disk 35 of the tightening-and-retwisting unit 9 rotates in the same direction and at the same speed as the rotary disk 18 of the loosening-and-untwisting unit 5.

As may be understood from the above, sequential lengths of untwisted steel wires are fed through the coating unit 6, the heating unit 7 and the primary cooling unit 8 while the surrounding steel wires 1*b* are kept apart from the core steel wire 1*a* by the wire expanders 15*a*, 15*b* and 15*c* and while the surrounding steel wires 1*b* are rotated by the rotary disk 18 of the untwisting unit 5, the rotation of which rotary disk 18 is transmitted to the following rotary disk 35 of the twisting unit 9. This assures the even formation of corrosion protection coatings 30 (about 200μ) on the surrounding and core steel wires.

The synchronous rotation of the rotary disks both of the untwisting and twisting units 5 and 9 in same direction assures that the surrounding steel wires are wound about the core steel wire in the same direction in which the surrounding steel wires were wound about the core steel wire prior to the untwisting of the prestressing strand, thus permitting the quick and easy winding of the surrounding steel wires about the core steel wire.

The 200 micron-thick corrosion protection coatings on the core and surrounding steel wires 1*a* and 1*b* increase the diameters of these wires accordingly, and the coated, surrounding steel wires 1*b* must travel an increased circumferential distance about the coated core steel wire 1*a*, specifically being increased by the circumferential coating thickness of the coated core steel wire.

As a result the surrounding steel wires are apparently shortened, and are not long enough to make both ends of the surrounding and core steel wires meet when the twisting is finished. According to calculated estimation the core steel wire will have an extra length of about 0.7 millimeters per untwisted length of 1 meter. Assume that a coil of prestressing strand weighing 1 ton is subjected to corrosion protection coating process and that the prestressing strand is about 12.7 millimeters across. The coiled lot of prestressing strand if uncoiled and extended, will be 1,300 meters long, and its core steel 1*a* wire will have an extra length of 900 millimeters left unwound by the surrounding steel wires.

Figure 5:
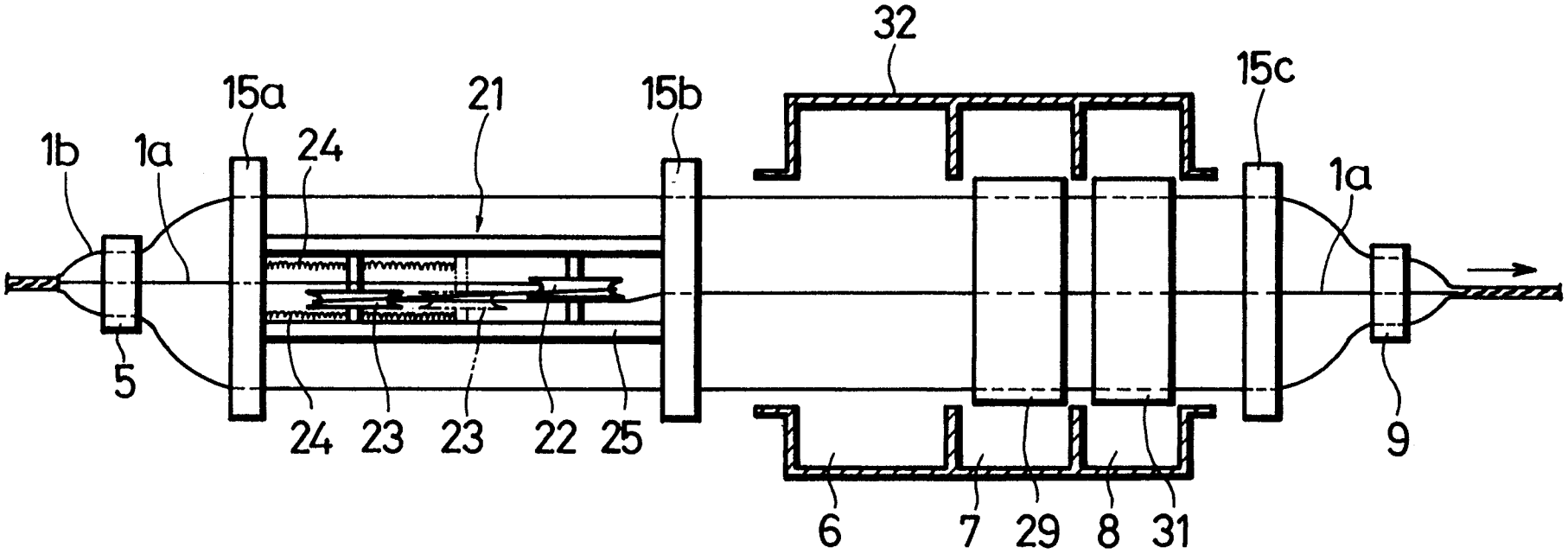
FIG. 5 shows schematically a core-length adjuster.

With a view to adjusting the core steel length to make both ends of the surrounding and core steel wires to meet, the core length adjuster 21 is placed between the first wire expander 15*a* and the second wire expander 15*b*. As seen from FIG. 5, the core steel wire 1*a* extends from the untwisting unit 5 to pass through the wire expander 15*a*, going downstream around the stationary sheave 22 and coming back upstream around the movable sheave 23, and again going downstream to pass through the wire expander 15*b* to the coating unit 6.

The core steel wire 1*a* goes around the stationary sheave 22 and then around the movable sheave 23, which is initially put close to the stationary sheave 22 (phantom lines), and the movable sheave 23 is spring-biased so as to be able to move apart from the stationary sheave 22, so that the leading length of core steel wire 1*a* having the surrounding steel wires 1*b* already wound thereabout may be kept stretched between the untwisting unit 5 and the twisting unit 6 all the time.

With this arrangement an ever increasing extra length of core steel wire 1*a* will be increasingly pulled backward so as to make both ends of the surrounding steel wires 1*b* and the core steel wire 1*a* to meet in the sequential twisted length of coated steel wires. If the traveling distance of the movable sheave 23 is set one meter, the length of core steel wire extending from the movable sheave 23 to the stationary sheave 22 and back to the movable sheave, 23 will be two meters long, and will be long enough to permit the required adjustment of the presumable extra core length in coating a coiled lot of prestressing strand weighing one ton.

Every time a one-ton heavy coiled lot of prestressing strand has been coated, the movable sheave 23 is returned to the initial position (phantom lines), removing the remaining length of core steel wire 1*a*, and then the coating of another coiled lot of prestressing strand can be started. If it is desired that the preceding coated prestressing strand is connected to the subsequent prestressing strand, which is to be coated, the leading end of the subsequent prestressing strand is untwisted by hand, and likewise the trailing end of the preceding coated prestressing strand is untwisted by hand to pull backward the core steel wire 1*a* from the untwisting unit 5, causing the movable sheave 23 to move toward the stationary sheave 22 against the coiled spring 24, and cutting the remaining length of core steel wire so as to make both trailing ends of the surrounding and core steel wires to meet, and finally the leading ends of the core and surrounding steel wires of the subsequent prestressing strand are heated and melted to be connected to the trailing ends of the core and surrounding steel wires of the preceding coated, prestressing strand. Thus, continuous processing of sequential coiled lots of prestressing strand is permitted.

Figure 9:
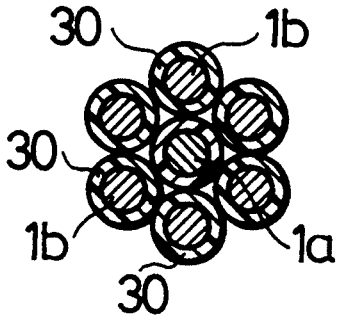
FIG. 9 is a cross section of a prestressing strand having corrosion protection coating on each wire.

The coated prestressing strand 38 is shown in cross section in FIG. 9. It is cooled to normal temperature in the secondary cooling unit 10. Thereafter, the diameter of the coated prestressing strand 38 is measured to make a decision as to whether a required corrosion protection coating is formed.

For instance, the coated prestressing strand 38 is measured in two dimensions, for instance In the X- and Y-axes, and if the measured size should be found out of the permissible range, for instance, ±50μ for a 200 micron thick corrosion protection coating, warning signals are generated or the whole system is made to stop.

At the subsequent step a decision is made as to whether the corrosion protection coating 30 has pinholes in the pinhole detector 12, which is of non-contact type, for instance, using an optical detector means. Pinholes If any, are detected, and then, such pinholes are marked; and warning signals are generated or the whole system is made to stop.

The pull-in unit 13 holds the corrosion protection coated prestressing strand 38 between its upper and lower endless belts 13*a* and 13*b*, and the pull-in unit 13 hauls in the corrosion protection coated prestressing strand 38, thus allowing the coiling unit 14 to coil the corrosion protection coated prestressing strand 38.

At outset, the whole system must be ready to feed a prestressing strand 1 from the upstream end. The leading end of the prestressing strand 1 is untwisted by hand to pass the surrounding and core steel wires 1*b* and 1*a* through the circumferential and center guide apertures 19 and 20 of the rotary disk of the untwisting unit 5, and the leading ends of the untwisted steel wires are drawn to pass to the coiling stand 14 through the coating unit 6, the heating unit 7, the primary cooling unit 8, the retwisting unit 9 and the secondary cooling unit 10 while keeping the surrounding steel wires 1*b* apart from the center core steel wire 1*a* by the wire expanders 15*a*, 15*b* and 15*c* . Thus, the selected length of untwisted strand may be expanded, coated and twisted to the original shape.

Alternatively a predetermined length of dummy surrounding and core steel wires may be set in the whole system in the same way as just described, although these dummy steel wires start from the downstream end, that is, the coiling stand 14, extending toward the upstream end, that is, toward the wire feeding stand 2. The leading end of the prestressing strand from the uncoiling stand 2 is untwisted by hand to remove rust and be cleaned in the polishing unit 4, and the ends of the surrounding and core steel wires thus cleaned are heated and welded to the ends of the dummy surrounding and core steel wires. Then, the untwisted strand to be coated is made to pass to the coiling stand 14 through the whole system by hauling the dummy wire rope downstream. This alternative has the effect of improving the working efficiency.

When the coating of a coiled lot of prestressing strand 1 is almost finished, another coiled lot of prestressing strand 1 is set on the wire feeding stand 2, and the leading end of the prestressing strand 1 is pulled out by the pull-out unit 3 to remove rust and be cleaned in the polishing unit 4. The rust removed and cleaned end of the prestressing strand is untwisted by hand to heat and weld the leading ends of the surrounding and core steel wires to the trailing ends of the surrounding and core steel wires of the preceding prestressing strand, the coating of which is almost finished. Thus, a plurality of coiled lots of prestressing strand can be coated continuously, permitting the whole system to run without intermission. After coating a series of coiled lots may be separated at each welding joint at the coiling unit 14.

In coating a relatively thick prestressing strand, the surrounding and core steel wires are thick enough to transmit rotating power from the untwisting unit 5 to the retwisted unit 9 via the wire expanders 15*a*, 15*b* and 15*c*. In coating a relatively thin prestressing strand, however, the surrounding and core steel wires are too thin to transmit rotating power from the untwisting unit 5 to the retwisted unit 9 via the wire expanders 15*a*, 15*b* and 15*c*, causing undesired twisting on the way to the retwisting unit 9.

Figure 10:
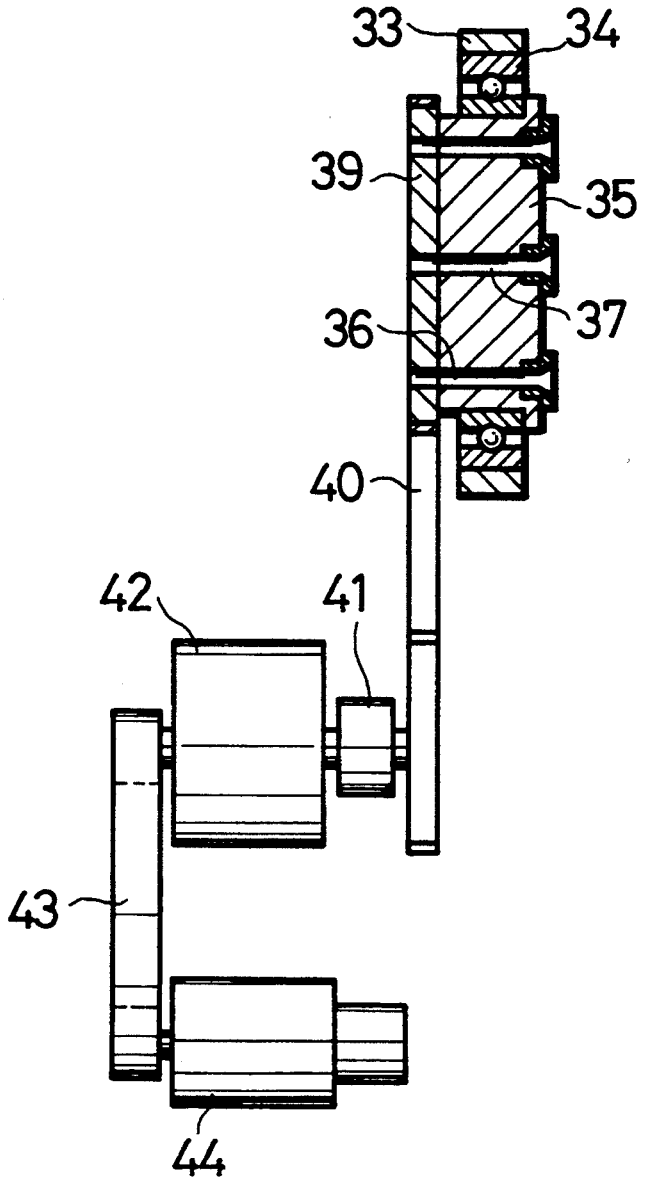
FIG. 10 shows another example of a tightening-and-retwisting means.

With a view to eliminating such undesired twisting, the twisting unit 9 may be equipped with extra drive to rotate its rotary disk 35 as seen from FIG. 10. Specifically, a timing pulley 39 is integrally connected to the rotary disk 35 of the retwisting unit 9, and the timing pulley 39 is connected to a decelerator 42 by a timing belt 40 and a powder clutch 41, and the decelerator 42 is adapted to be driven by an inverter motor 44 through the agency of an associated drive belt 43.

In operation the inverter motor 44 rotates synchronously with rotation of tile rotary disk of the untwisting unit 5 and the feeding speed of the prestressing strand to give a forced rotation to the timing pulley 39 via the decelerator 42, thus causing the rotary disk 35 of the retwisting unit 9 to rotate synchronously with the rotary disk 18 of the untwisting unit 5, assuring that the surrounding steel wires 1*b* are wound about the core steel wire 1*a* to provide the original twisted wire shape.

The rotating of the retwisting rotary disk synchronous with the untwisting rotary disk causes the synchronous rotation of the expanders 15*a*, 15*b* and 15*c*, thus eliminating the possibility of undesired wire twisting, which otherwise, would be caused in case of relatively thin steel wires.

As may be understood from the above, the method of forming corrosion protection coatings on prestressing strands according to the present invention comprises the steps of untwisting sequential lengths of a prestressing strand; keeping the surrounding steel wires apart from the core steel wire to coat these steel wires with a synthetic resin; and retwisting the coated steel wires to provide the original shape of prestressing strand, thus permitting the separate coating of each steel wire.

The arrangement of a coating unit and heating-and-curing unit between the untwisting unit and the retwisting unit permits continuous corrosion protection coating formation on the surface of each steel wire.

The use of a core-length adjuster permits both ends of the surrounding and core wires of an elongated wire rope to meet when the required retwisting is finished.

We claim:

1. Apparatus for forming coatings on a twisted prestressing strand comprising:

means for loosening and untwisting sequentially selected lengths of a twisted prestressing strand having a core steel wire and plural surrounding steel wires wound about the core wire;

means positioned after said loosening and untwisting means for applying pulverized synthetic resin to surfaces of each of the surrounding steel wires and core steel wire;

means positioned after said applying means for heating and melting the synthetic resin applied to the steel wires;

means positioned after said heating and melting means for cooling the resin-coated surrounding and core steel wires; and means positioned after said heating means and cooling means for tightening and retwisting the resin-coated surrounding steel wires about the resin-coated core steel wire.

2. Apparatus for forming coatings on a twisted prestressing strand comprising:

means for loosening and untwisting sequentially selected lengths of a twisted prestressing strand having a core steel wire and plural surrounding steel wires wound about the core wire;

means for applying pulverized synthetic resin to surfaces of each of the surrounding steel wires and core steel wire means for heating and melting the synthetic resin applied to the steel wires;

means for cooling the resin-coated surrounding and core steel wires; and means for tightening and retwisting the resin-coated surrounding steel wires about the resin coated core steel wire;

wherein the loosening-and-untwisting means comprises a rotary disk having a center guide aperture to permit the core steel wire to pass therethrough and a plurality of circumferential guide apertures to permit the surrounding steel wires to pass therethrough, said circumferential guide apertures being arranged on a circle having the center guide aperture as its center.

3. Apparatus for forming coatings on a twisted prestressing strand according to claim 2, wherein the loosening-and-untwisting means is structurally similar to the tightening-and-re-twisting means;

said apparatus includes an expanding means positioned on the strand between the loosening-and-untwisting means and the tightening-and-re-twisting means, said expanding means having a core wire guide and surrounding wire guides to keep the surrounding steel wires radially apart from the core steel wire; and the apparatus further comprising a core length adjusting means placed on the core steel wire between the loosening-and-untwisting means and the tightening-and-twisting means, said core length adjusting means having a stationary sheave and a movable sheave which is spring-biased in a given constant direction with respect to the stationary sheave.

4. Apparatus for forming coatings on a twisted prestressing strand according to claim 3, further comprising drive means to rotate the tightening-and-re-twisting means synchronously with the loosening-and-untwisting means in the same direction.

* * * * *